US006615519B2

(12) United States Patent
Hess

(10) Patent No.: US 6,615,519 B2
(45) **Date of Patent: *Sep. 9, 2003**

(54) FLAME SIMULATING ASSEMBLY

(75) Inventor: Kristoffer Hess, Cambridge (CA)

(73) Assignee: Dimplex North America Limited, Cambridge (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/837,434

(22) Filed: Apr. 19, 2001

(65) Prior Publication Data

US 2002/0023376 A1 Feb. 28, 2002

Related U.S. Application Data

(63) Continuation-in-part of application No. 09/649,043, filed on Aug. 29, 2000, now Pat. No. 6,564,485.

(51) Int. Cl.[7] ..... G09F 19/00

(52) U.S. Cl. ..... 40/428; 392/348

(58) Field of Search ..... 40/428; 362/92, 362/253, 806; 392/348; 472/65

(56) References Cited

U.S. PATENT DOCUMENTS

| | | | | |
|---|---|---|---|---|
| 1,199,882 A | | 10/1916 | Frey | |
| 1,590,083 A | | 6/1926 | Collins | |
| 1,604,850 A | * | 10/1926 | Payne | 40/428 |
| 1,703,761 A | | 2/1929 | Berry | |
| 1,719,622 A | | 7/1929 | Price | |
| 1,901,294 A | | 3/1933 | Gritt et al. | |
| 1,992,540 A | | 2/1935 | Newton | |
| 2,009,167 A | | 7/1935 | Delano | |
| 2,285,535 A | | 6/1942 | Schlett | |
| 2,984,032 A | | 5/1961 | Cornell | |
| 3,395,476 A | | 8/1968 | Moss et al. | |
| 3,499,239 A | | 3/1970 | Mungo | |
| 3,526,984 A | | 9/1970 | Nielsen et al. | |
| 3,603,013 A | | 9/1971 | Reed et al. | |
| 3,699,697 A | | 10/1972 | Painton | |
| 3,978,598 A | | 9/1976 | Rose et al. | |
| 4,890,600 A | | 1/1990 | Meyers | |
| 4,965,707 A | | 10/1990 | Butterfield | |
| 5,642,580 A | | 7/1997 | Hess et al. | |
| 6,047,489 A | | 4/2000 | Hess et al. | |
| 6,162,047 A | | 12/2000 | Hess | |

FOREIGN PATENT DOCUMENTS

| | | |
|---|---|---|
| EP | 0611921 B1 | 9/1999 |
| EP | 1020685 A2 | 7/2000 |
| GB | 272362 | 6/1927 |
| GB | 414280 | 8/1934 |
| GB | 968568 | 9/1964 |
| GB | 978364 | 12/1964 |
| GB | 1088577 | 10/1967 |

(List continued on next page.)

OTHER PUBLICATIONS

Final Report—May, 1997, Pertinent pp.: 5–1 to 5–5 Residential Electric Fireplaces, Review of the State of the Art Electric Power Research Institute.

*Primary Examiner*—Brian K. Green

(57) ABSTRACT

A flame simulating assembly is provided having a simulated fuel bed, a light source, and a screen having a partially reflective front surface disposed behind the simulated fuel bed for reflecting an image of the simulated fuel bed and for transmitting light from the light source through the partially reflective front surface so that an image of flames is transmitted through the partially reflective front surface. The flame simulating assembly also includes a static reflector disposed in front of the simulated fuel bed and having an inner surface disposed opposite an outer surface. The inner surface is disposed adjacent to the simulated fuel bed and has a static reflective surface thereon. The static reflective surface is positioned for reflecting light from the light source onto the simulated fuel bed to simulate burning embers.

50 Claims, 11 Drawing Sheets

FOREIGN PATENT DOCUMENTS

| | | | |
|---|---|---|---|
| GB | 1186655 | | 4/1970 |
| GB | 1443772 | | 7/1976 |
| GB | 1457540 | | 12/1976 |
| GB | 2149090 | A | 6/1985 |
| GB | 2151772 | A | 7/1985 |
| GB | 2180927 | B | 11/1988 |
| GB | 2240171 | A | 7/1991 |
| GB | 2256040 | A | 11/1992 |
| GB | 2264555 | A | 9/1993 |
| GB | 2290865 | A | 1/1996 |
| GB | 2298073 | | 8/1996 |
| WO | PCT/CA97/00299 | | 11/1997 |
| WO | PCT/CA99/00190 | | 9/1999 |

* cited by examiner

FLAME SIMULATING ASSEMBLY

This is a continuation-in-part of application Ser. No. 09/649,043, filed on Aug. 29, 2000, now U.S. Pat. No. 6,564,485.

FIELD OF THE INVENTION

The invention relates to flame simulating assemblies for use in electric or gas fireplaces and, in particular, to a static reflector.

BACKGROUND OF THE INVENTION

In general, known flame simulating devices have been primarily directed to simulating flames arising from simulated burning fuel. The known devices may include a simulation of a burning ember bed forming part of the simulated burning fuel, or positioned below the simulated burning fuel. Typically, the simulated burning fuel and the simulated ember bed are intended to resemble burning logs or burning coal. Where, as is usually the case, the simulated ember bed is positioned at the front of the flame simulating assembly, the simulation of a burning ember bed can contribute significantly to the overall effect achieved by the flame simulating assembly.

Positioning a static reflector inside the simulated ember bed is known. Such positioning of a static reflector is disclosed in U.K. Patent No. 414,280 (Davis et al.), U.K. Patent No. 1,186,655 (Reed et al.), U.S. Pat. No. 1,992,540 (Newton), U.S. Pat. No. 3,699,697 (Painton), U.S. Pat. No. 3,978,598 (Rose et al.), and U.S. Pat. No. 4,890,600 (Meyers). In each of these patents, however, a static reflector is positioned inside a structure which forms all or a portion of a simulated pile of burning fuel.

There is a continuing need for a flame simulating assembly that more realistically simulates burning logs or coal, and burning embers of burning logs or coal.

SUMMARY OF THE INVENTION

In one of its aspects, the invention provides a flame simulating assembly having a simulated fuel bed, a light source, and a screen having a partially reflective front surface disposed behind the simulated fuel bed for reflecting an image of the simulated fuel bed and for transmitting light from the light source through the partially reflective front surface so that an image of flames is transmitted through the partially reflective front surface. The flame simulating assembly also has a static reflector disposed in front of the simulated fuel bed. The static reflector has an inner side disposed opposite an outer side. The inner side is disposed adjacent to the simulated fuel bed and has a static reflective surface thereon. The static reflective surface is positioned for reflecting light from the light source onto the simulated fuel bed.

In another of its aspects, the invention provides a flame simulating assembly having a simulated fuel bed and a light source disposed below the simulated fuel bed. The simulated fuel bed includes a simulated ember bed, which has at least one translucent portion. The flame simulating assembly also includes a static reflector disposed in front of the simulated fuel bed, the static reflector having an inner side disposed opposite an outer side. The inner side is disposed adjacent to the simulated ember bed and has a static reflective surface thereon. The at least one translucent portion is positioned in a path of light from the light source to the static reflective surface, and the static reflective surface is positioned for reflecting light from the light source onto the simulated fuel bed.

In yet another of its aspects, the invention provides a flame simulating assembly having a simulated fuel bed and a light source disposed below the simulated fuel bed. The simulated fuel bed includes a simulated ember bed, which has at least one aperture. The flame simulating assembly also has a static reflector disposed in front of the simulated fuel bed, the static reflector having an inner side disposed opposite an outer side. The inner side is disposed adjacent to the simulated ember bed and has a static reflective surface thereon. The at least one aperture is positioned in a path of light from the light source to the static reflective surface, and the static reflective surface is positioned for reflecting light from the light source onto the simulated fuel bed.

BRIEF DESCRIPTION OF THE DRAWINGS

The invention will be better understood with reference to the drawings, in which.

DETAILED DESCRIPTION OF THE PREFERRED EMBODIMENT(S)

Figure 1:
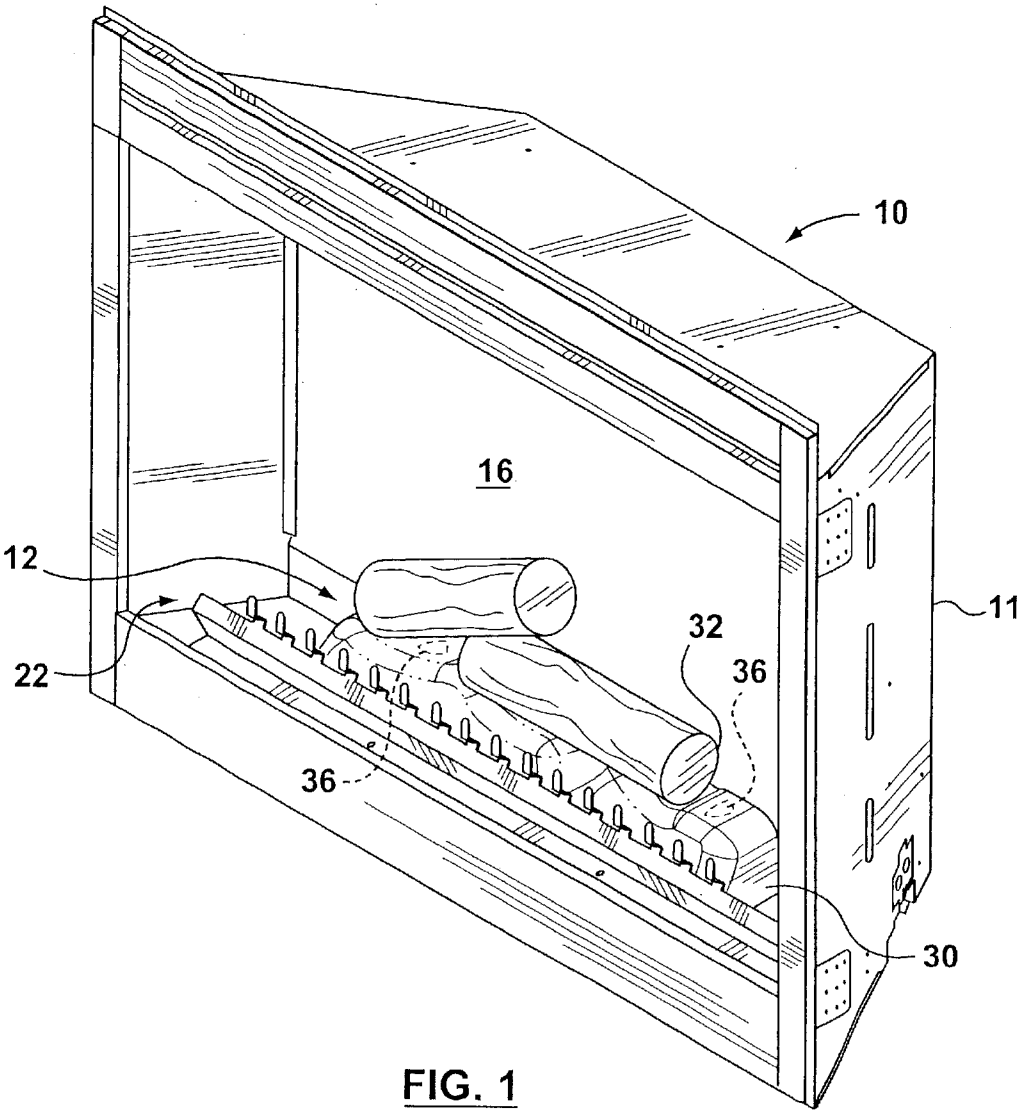
FIG. 1 is an isometric view of the front of a flame simulating assembly incorporating a preferred embodiment of the invention, including a static reflector and a screen.
Figure 2:
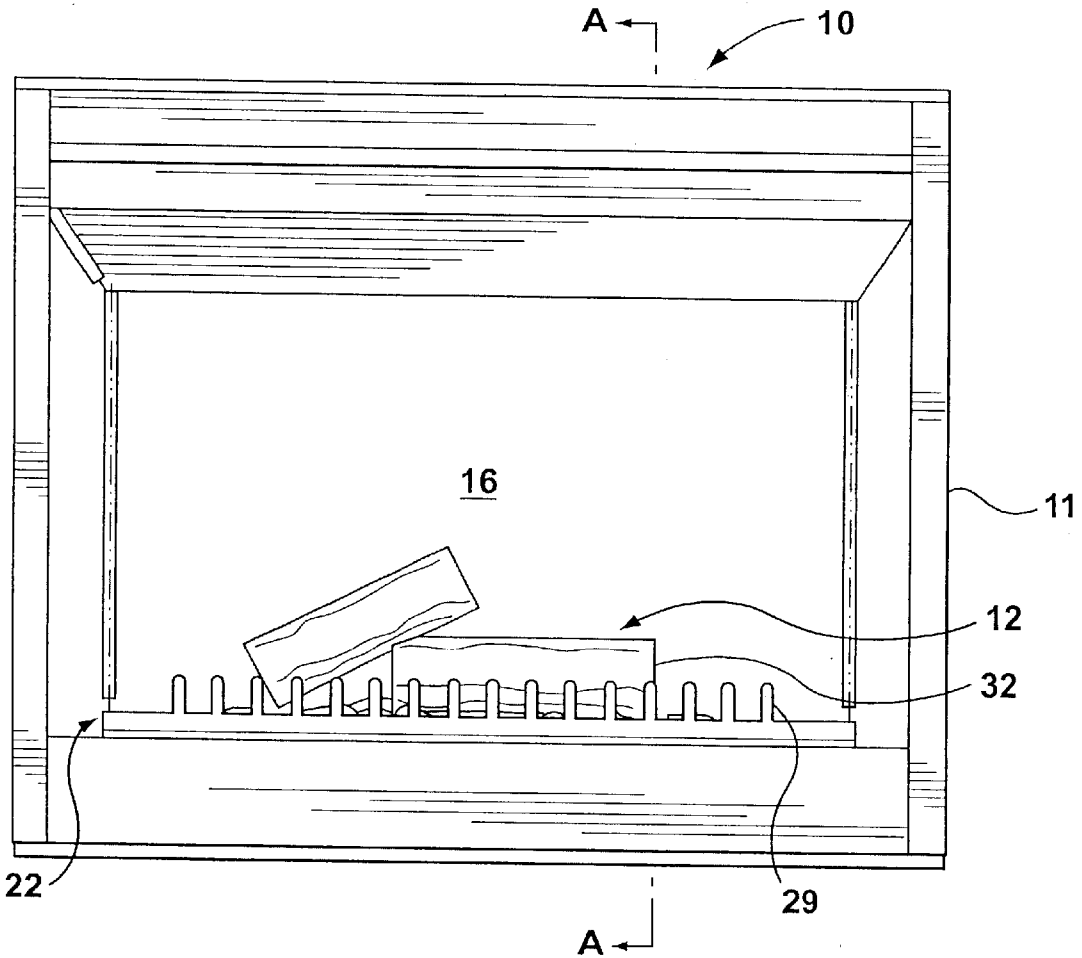
FIG. 2 is a front view of the flame simulating assembly of FIG. 1.
Figure 3:
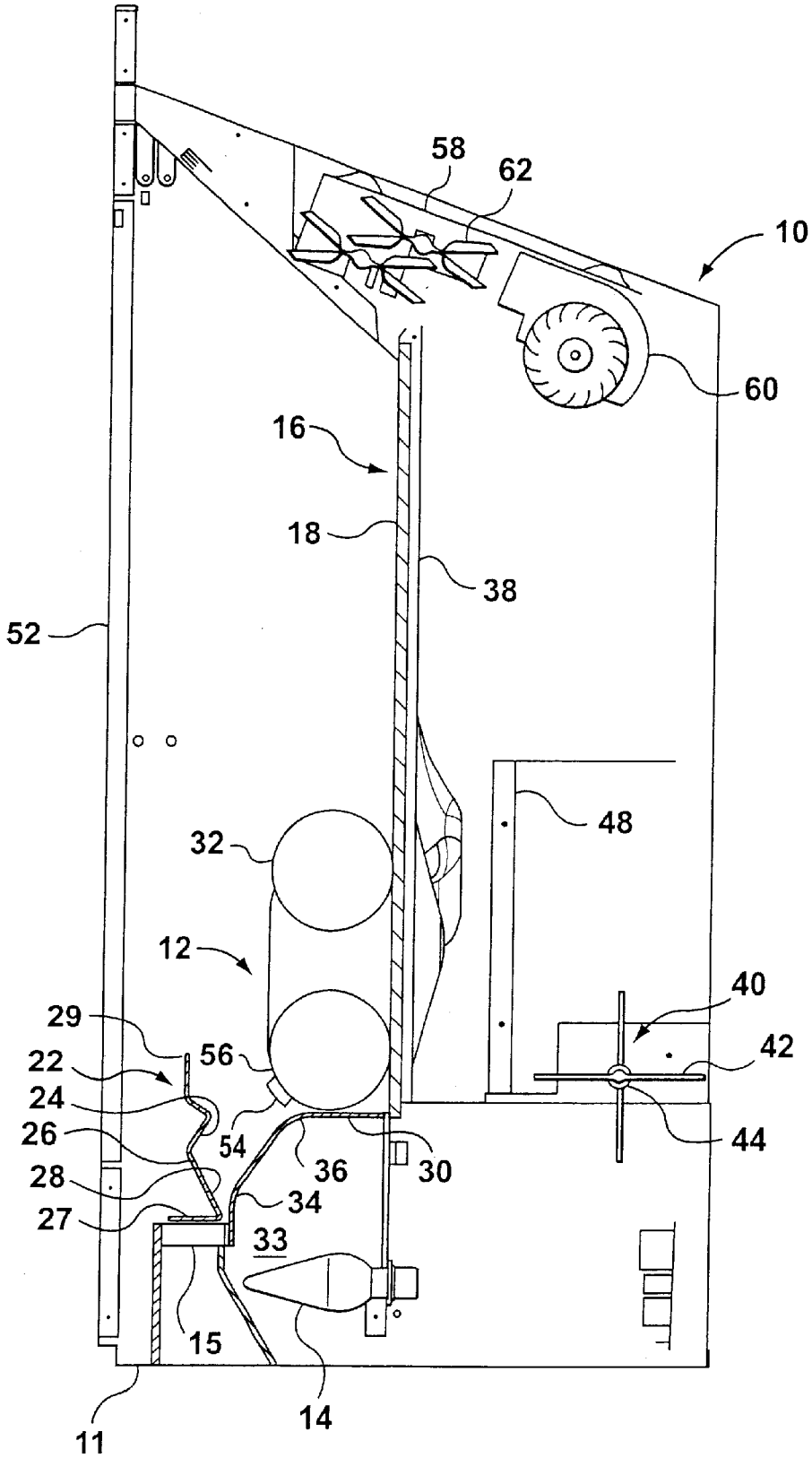
FIG. 3 is a section along line A—A of FIG. 2, drawn at a larger scale than FIG. 2, showing the preferred embodiment of the invention.

Reference is first made to FIGS. 1 and 3 to describe a preferred embodiment of a flame simulating assembly indicated generally by the numeral 10 and made in accordance with the invention The flame simulating assembly 10 includes a housing 11, a simulated fuel bed 12, a light source 14, and a screen 16, and is connected to an electrical power source (not shown). The simulated fuel bed 12, the light source 14, and the screen are positioned within and fastened to the housing 11. As will be described, the housing 11 includes a bottom wall element 15 (FIG. 3). The function and structure of the screen 16 are as described in U.S. Pat. No. 5,642,580, the disclosure of which is incorporated herein by reference. The screen 16 has a partially reflective front surface 18 for reflecting an image of the simulated fuel bed 12 and for transmitting light from the light source 14 through the partially reflective front surface 18 so that an image of flames appears through the screen 16, as will be described in more detail. As can be seen in FIG. 3, an static reflector 22 is disposed in front of the simulated fuel bed 12 and has an inner side 24 disposed opposite an outer side 26. The static reflector 22 is attached to the bottom wall element 15. Although other arrangements could be employed, as shown in FIG. 7, the static reflector 22 has a mounting flange 27 through which fasteners (not shown) are placed, to attach the static reflector 22 to the bottom wall element 15.

Figure 6:
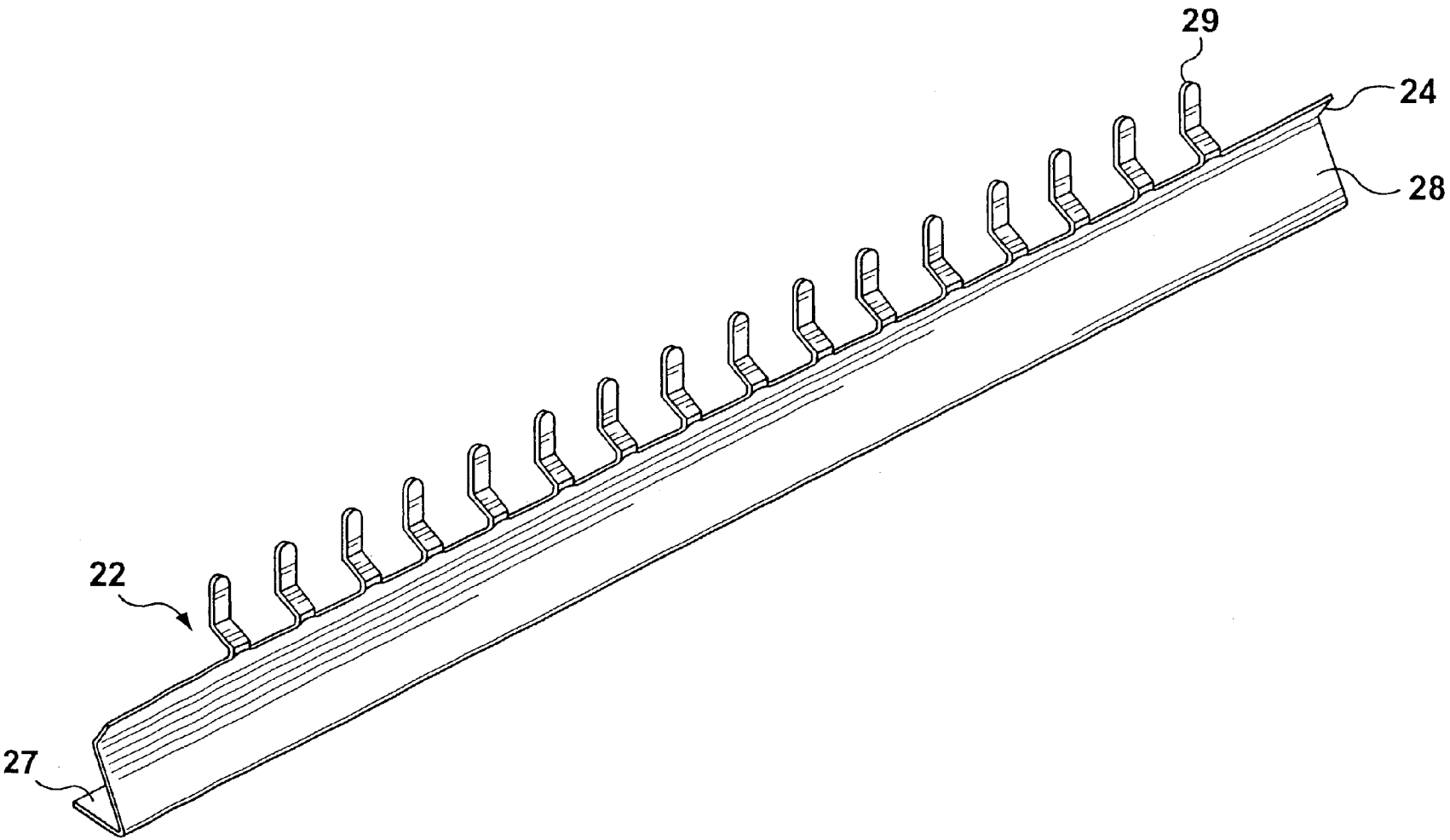
FIG. 6 is an isometric view of the back of the static reflector of FIG. 1, drawn at a larger scale than FIG. 1.
Figure 7:
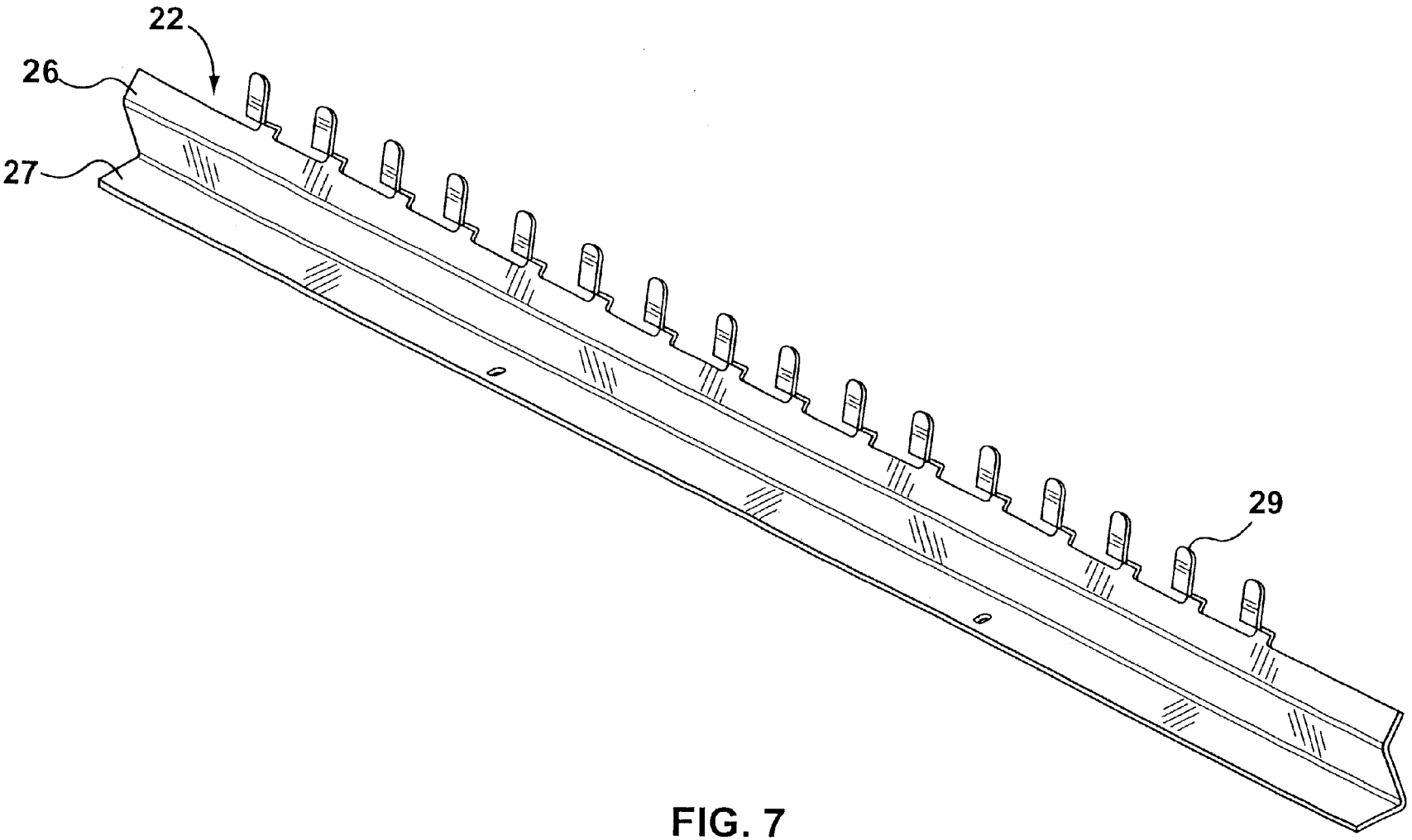
FIG. 7 is an isometric view of the front of the static reflector of FIG. 6.

The shape of a preferred embodiment of the static reflector 22 can best be seen in FIGS. 6 and 7. The inner side 24 is disposed adjacent to the simulated fuel bed 12 and has a static reflective surface 28 thereon. The static reflective surface 28 is positioned for reflecting light from the light source 14 onto the simulated fuel bed 12. While other arrangements could be employed, the static reflector 22 is formed of a single piece of sheet metal of suitable thickness, shaped and cut accordingly. In a preferred embodiment, the shape of the static reflector 22 generally is such that, when the static reflector 22 is installed in the housing 11, the mounting flange 27 is substantially horizontal, and the static reflective surface 28 is positioned for reflecting light from the light source 14 onto the simulated fuel bed 12. Preferably, the mounting flange 27 is adapted to be attached to the bottom wall element 15. As will be described farther, because the static reflector 22 is disposed outside the simulated fuel bed 12, the positioning of the static reflective surface 28 is determined relative to the simulated fuel bed 12. Preferably, the static reflective surface 28 is finished so that it is substantially reflective. Various arrangements can be employed to achieve the desired reflectivity. In a preferred embodiment, the static reflective surface 28 is created by placing the adhesive side of a decal comprising an elongate strip of silvered mylar or other suitable plastic material on the appropriate part of the inner side 24. Alternatively, the static reflective surface 28 can comprise stainless steel fastened to the inner side 24, finished to enhance reflectivity, or a mirror. The static reflective surface 28 preferably extends substantially along the length of the static reflector 22, along a lower region of the inner side 24, disposed transversely to the mounting flange 27. Preferably, the outer side 26 of the static reflector 22 has a non-reflective finish, so as to resemble a grate which may be used in an actual fireplace in which wood or coal is burned. The static reflector 22 also preferably includes a plurality of prongs 29, as can best be seen in FIGS. 6 and 7, disposed substantially parallel to each other, extending generally upwardly, and disposed substantially along the length of the static reflector 22. The prongs 29 resemble prongs which typically would be found on a grate used in an actual fireplace.

In a preferred embodiment, the simulated fuel bed 12 includes a simulated ember bed 30 and a simulated fuel element, comprising a plurality of simulated logs indicated generally by the numeral 32 as shown in FIGS. 1–5 and 8. It can be seen in FIGS. 1, 2, 3, and 8 that the simulated logs 32 are disposed above the simulated ember bed 30. Although the simulated logs 32 resemble logs of wood, the simulated fuel element can, alternatively, resemble a plurality of lumps of coal (not shown).

Preferably, the simulated ember bed 30 is directly attached to the bottom wall element 15 (FIG. 3). The attachment of the simulated ember bed 30 to the bottom wall element 15 can be effected by any suitable means. As can be seen in. FIG. 3, the simulated ember bed 30 is positioned generally above the bottom wall element 15. As can be seen in FIGS. 3, 3A, 4,8, 8A, and 9, the simulated ember bed 30 and the bottom wall element 15 together define, at least in part, a compartment 33 in which the light source 14 is preferably located.

Figure 4:
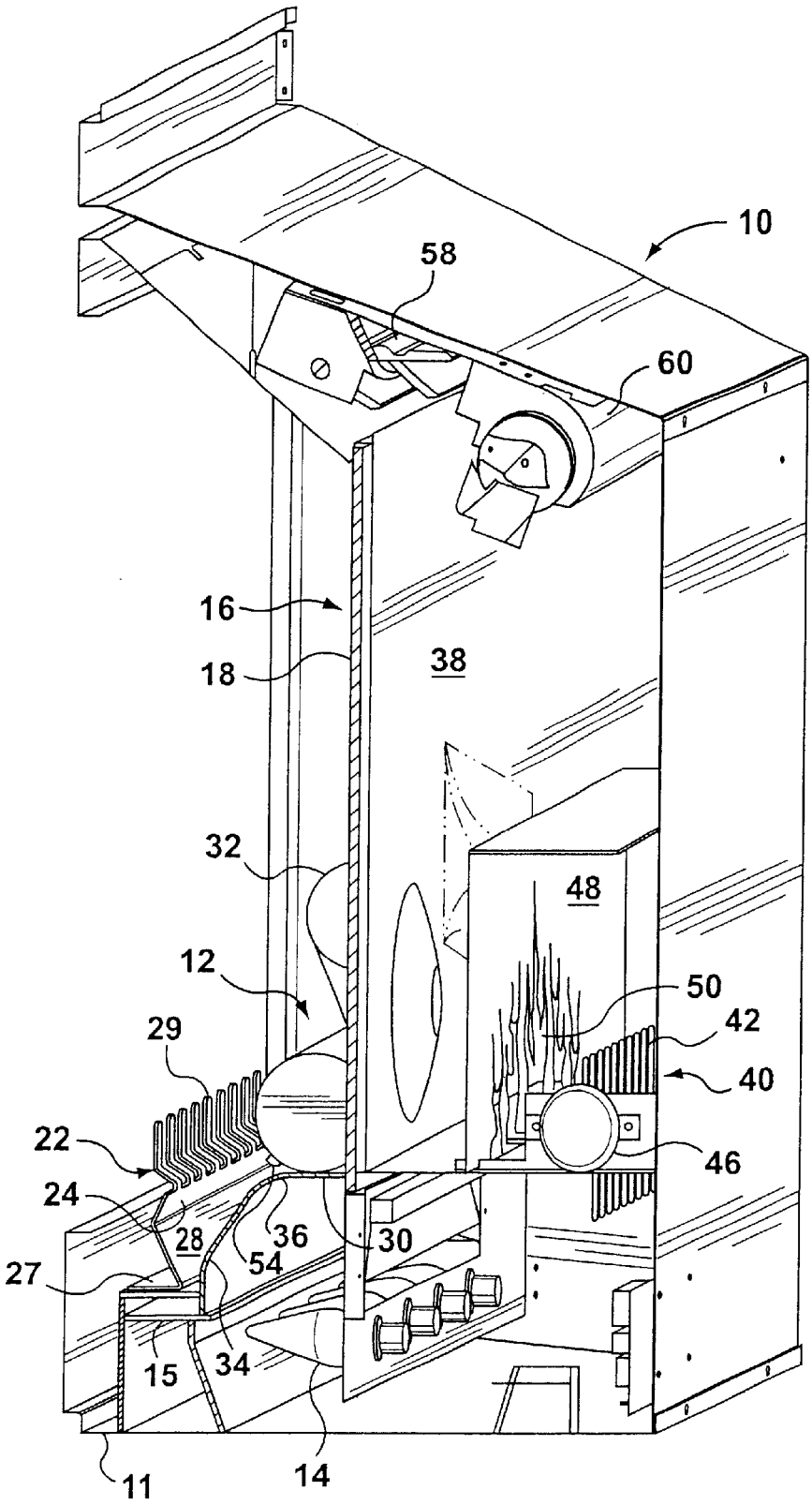
FIG. 4 is an isometric partly sectional view of the flame simulating assembly of FIG. 1, drawn at a larger scale than FIG. 1.
Figure 8:
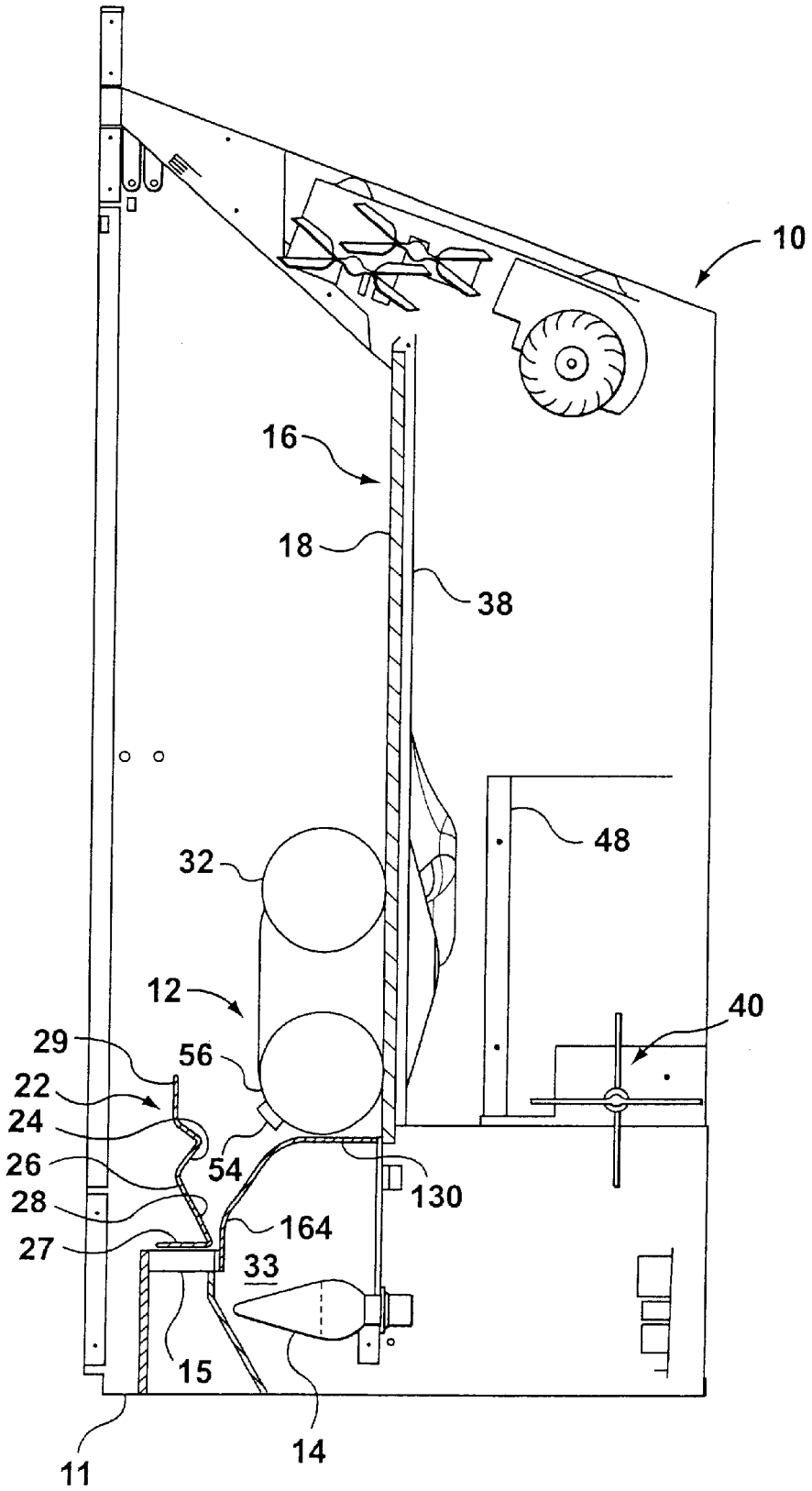
FIG. 8 is a sectional side view, similar to FIG. 3, of another embodiment of a flame simulating assembly according to the invention.

As can be seen in FIGS. 3,4 and 8, the static reflector 22 is positioned outside the simulated fuel bed 30. In particular, the static reflector 22 is positioned outside the compartment 33. Also, the light source 14 is positioned below the simulated fuel bed. In a preferred embodiment, and as shown in FIGS. 3 and 4, the simulated ember bed 30 includes a translucent portion 34 positioned in a path of light from the light source 14 to the static reflective surface 28. Light from the light source 14 is permitted to pass through the translucent portion 34 to the static reflective surface 28.

Figure 5:
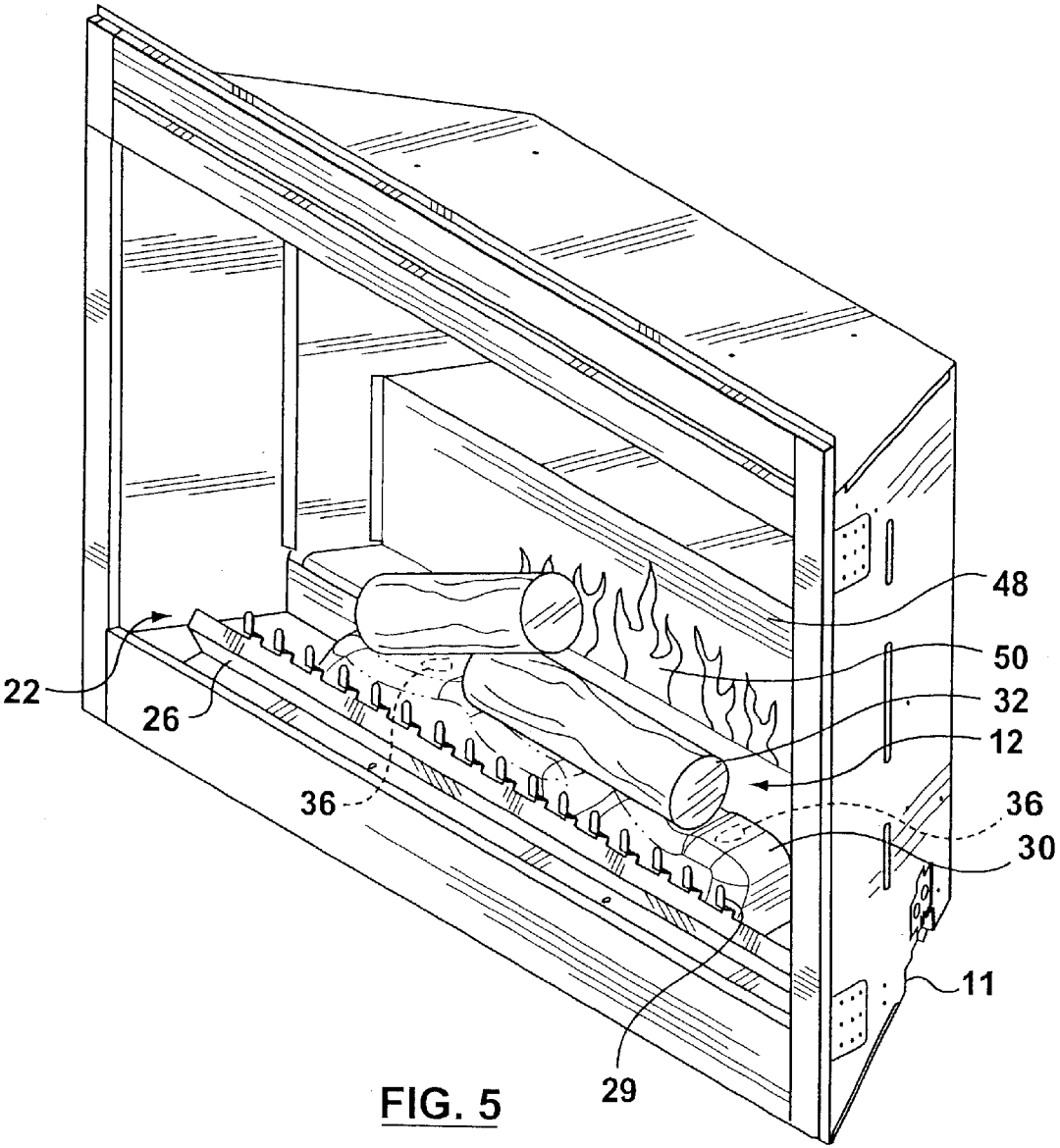
FIG. 5 is an isometric view of the front of the flame simulating assembly of FIG. 1, with the screen removed.

The coloring of the translucent portion 34 can be orange or any other suitable color. As will be described further, the effect which is sought when light is reflected from the static reflective surface 28 onto the simulated fuel bed 12 has an impact on the color selected for the translucent portion 34. Also, in addition to the translucent portion 34, the simulated ember bed 30 preferably includes a plurality of translucent parts 36 disposed so that the translucent parts 36 resemble burning embers when light from the light source 14 passes through them. By way of example, certain translucent parts 36 are shown in FIGS. 1 and 5.

Depending on the burning fuel which the simulated fuel bed 12 is intended to resemble, any suitable shades of the colors yellow, red, and orange, and any suitable mixtures of any of such colors, may be used in the translucent portion 34 or the translucent parts 36, or the static reflective surface 28. The term reddish, as used herein, refers to any suitable combination of colors used in the simulated fuel bed to simulate burning embers. As will be described further, preferably, the translucent portion 34 and the translucent parts 36 are reddish in color. The translucent portion 34 or the translucent parts 36 can include other colors.

Due to the positioning of the static reflector 22 relative to the translucent portion 34, an observer's view of the translucent portion 34 is generally obscured by the static reflector 22. Because of this, the coloring of the translucent portion 34 can be any color suitable for achieving the desired coloring of light from the light source 14 reflected from the static reflective surface 28 onto the simulated fuel bed 12. In comparison, those parts of the simulated ember bed 30 which are directly viewable are, as was described, shaped and colored to resemble the base of a wood or coal fire.

In a preferred embodiment, the screen 16 also includes a back member 38, disposed behind the partially reflective front surface 18, as described in Canadian Patent No. 2,310,367, the disclosure of which is incorporated herein by reference. The back member 38 is for diffusing and transmitting light from the light source 14 through the partially reflective front surface 18.

The preferred embodiment of the flame simulating assembly also includes a flicker element 40 positioned in a path of light transmitted from the light source to the back member 38, for causing the light to flicker. Preferably, and as disclosed in U.S. Pat. No. 5,642,580, the flicker element 40 comprises a plurality of strips 42 of substantially reflective material disposed around an axis 44 and extending radially outwardly from the axis 44. When the flame simulating assembly is operating, the flicker element 40 is rotated about the axis 44 by an electric motor 46. As the flicker element 40 is rotated about its axis 44 by the electric motor 46, the reflective strips 42 intermittently reflect light from the light source 14, so that the flicker element 40 causes the light from the light source 14 which is reflected by the flicker element 40 to flicker.

The preferred embodiment also includes a flame effect element 48. As described in U.S. Pat. No. 6,047,489, the disclosure of which is incorporated herein by reference, the flame effect element 48 is preferably made of sheet metal or any other suitable material. In the flame simulating assembly 10, the flame effect element 48 is positioned in a path of flickering light from the light source 14 which has been reflected by the flicker element 40, to configure the flickering light. As shown in FIG. 4 and FIG. 5, a flame pattern is cut into sheet metal to provide an opening 50 which configures the flickering light into an image of flames. As a result, an image of flickering flames is transmitted through the partially reflective front surface 18.

Preferably, the flame simulating assembly 10 also includes a transparent front panel 52, which can be removed to permit access to other parts of the flame simulating assembly 10.

In a preferred embodiment, the simulated logs 32 include a plurality of partially reflective parts, the partially reflective parts comprising a plurality of ember decals 54, as can be seen in FIGS. 3 and 8. Preferably, the ember decals 54 are positioned on a plurality of generally downwardly directed portions 56 of the simulated logs 32. The ember decals 54 are as described in U.S. Pat. No. 6,162,047, the disclosure of which is incorporated herein by reference. Light from the light source 14 is reflected onto the ember decals 54 from the static reflective surface 28, and the ember decals 54 are positioned on the downwardly directed portions 56 accordingly. The ember decals 54 are for reflecting light from the light source 14 which is reflected onto the ember decals 54 from the static reflective surface 28, to simulate burning embers. When the ember decals 54 reflect light, the ember decals 54 cause a glow to emanate from the downwardly directed portions 56, simulating burning embers, and thereby contributing to the overall effect of the flame simulating assembly 10 on the viewer.

As noted above, in a preferred embodiment, color is used to enhance the simulation of burning embers. Preferably, the ember decals 54 are reddish in color. Because the color of the light which is reflected onto the ember decals 54 from the static reflective surface 28 affects the color of the light which glows from the ember decals 54 on the downwardly directed portions 56, the color of the translucent portion 34, and any coloring included in the static reflective surface 28, is to be considered when determining the color of the ember decals 54.

Figure 3A:
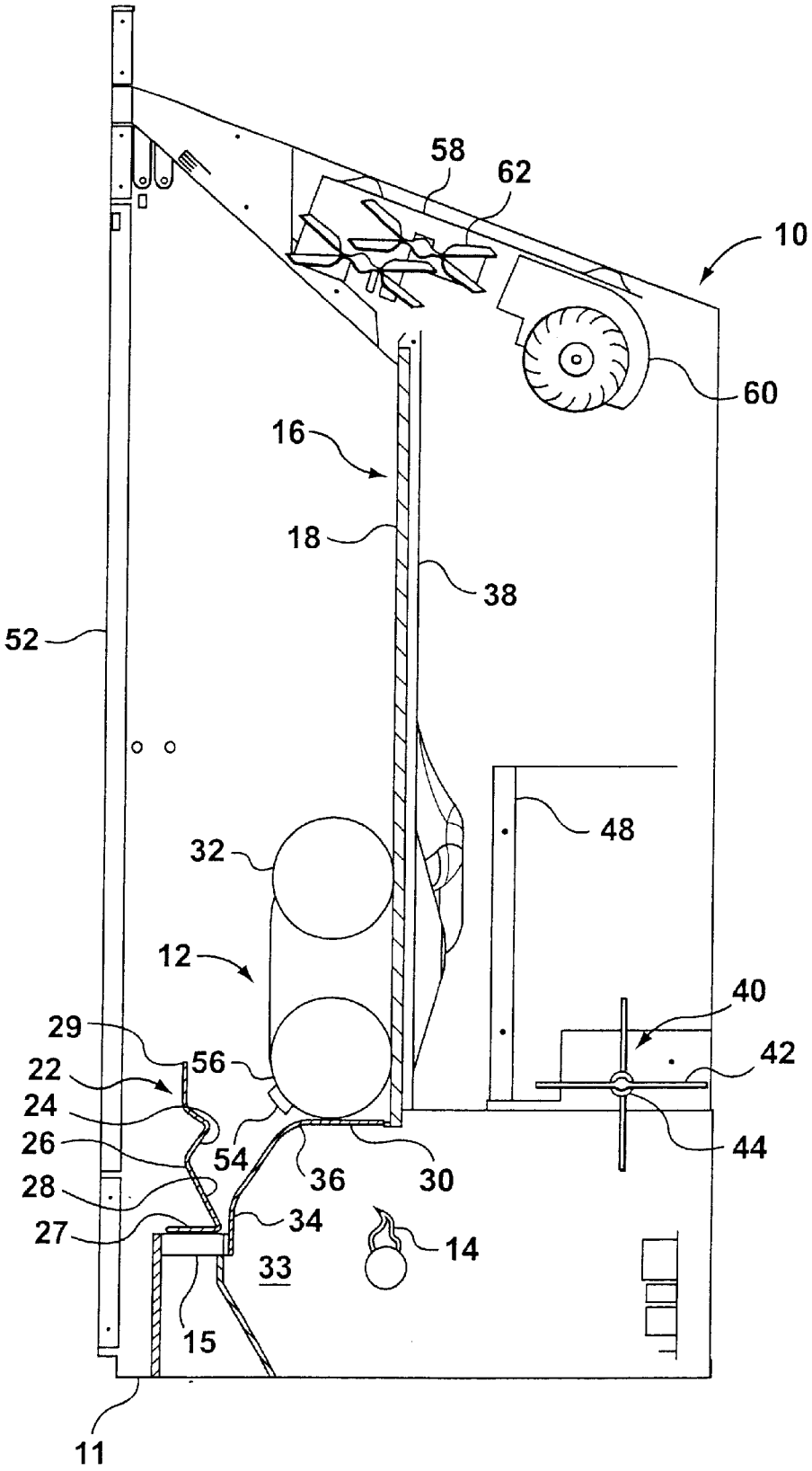
FIG. 3A is a section along line A—A of FIG. 2, drawn at a larger scale than FIG. 2, showing an alternative embodiment of the invention.

While other arrangements could be employed, as shown in FIGS. 3 and 4, the light source 14 comprises a plurality of electric light bulbs, operatively connected to a source of electricity. Alternatively, the light source 14 could be, for example, a natural gas flame (FIG. 3A).

In use, light from the light source 14 is transmitted through the translucent portion 34 to the static reflective surface 28, and reflected onto the simulated fuel bed 12 by the static reflective surface 28. In particular, light from the light source 14 which has been so reflected is also reflected onto the ember decals 54, and the light is reflected from the ember decals 54 to simulate burning embers disposed on the downwardly directed portions 56. Preferably, the translucent portion 34 and the ember decals 54 are reddish in color, so that a reddish glow emanates from the ember decals 54 when light from the light source 14 is reflected onto the ember decals 54 by the static reflective surface 28. The result is an improved simulation of burning embers due to the positioning of the static reflector 22 outside the compartment 33 reflecting light from the light source 14 onto the ember decals 54.

Light from the light source 14 also passes through the translucent parts 36, which also resemble glowing embers. At the same time, light from the light source 14 is caused to be a flickering light by the intermittent reflection of the light by the strips 42 in the flicker element 40. The flickering light is also configured by the flame effect element 48 so that an image of flames is transmitted through the partially reflective front surface 18.

Preferably, the flame simulating assembly 10 additionally includes a heater 58 providing heated air, and a blower 60 for blowing the heated air into the premises in which the flame simulating assembly 10 is disposed. As can be seen in FIGS. 3 and 8, the heater 58 can comprise a plurality of heating elements 62.

Figure 8A:
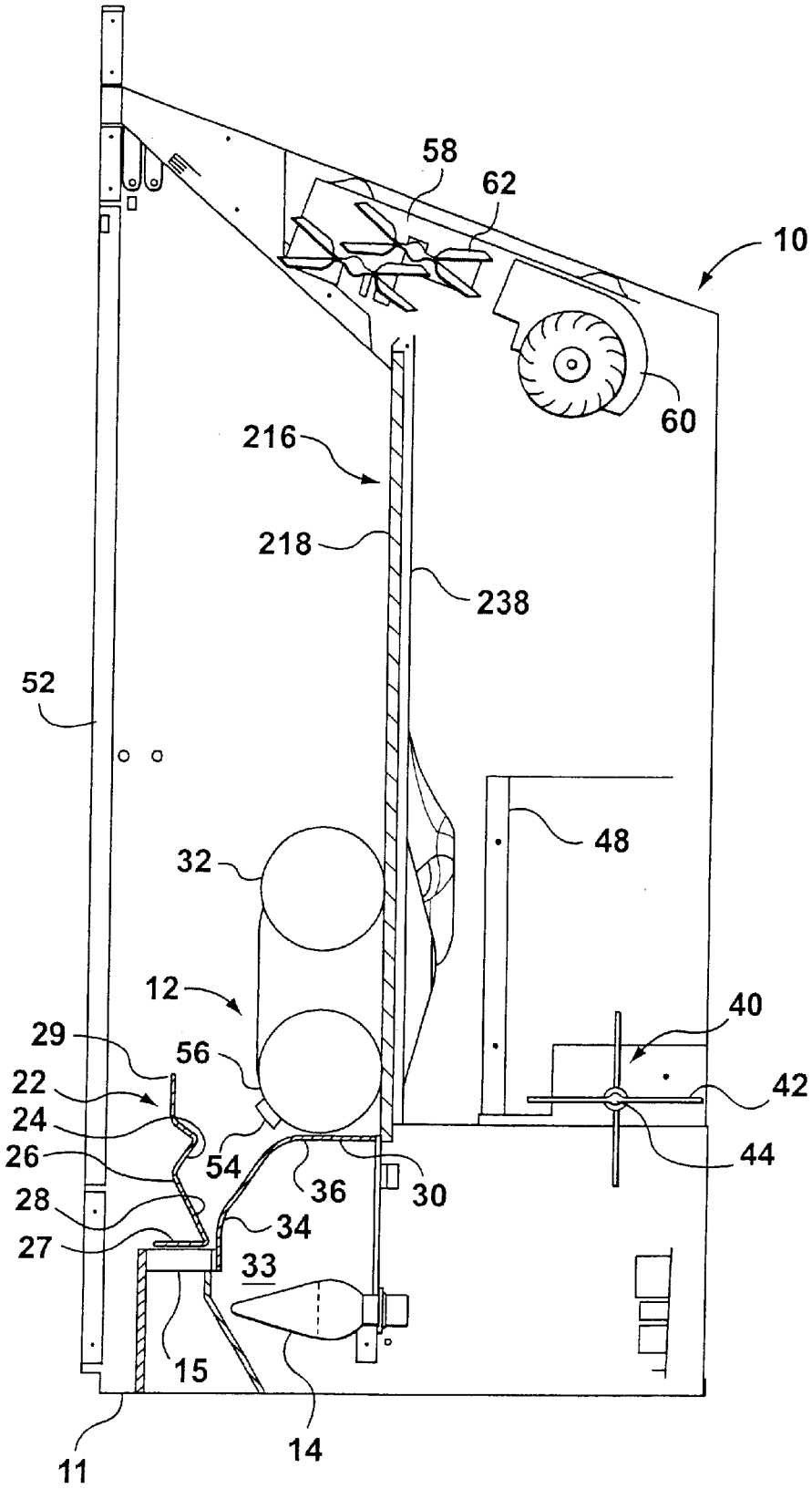
FIG. 8A is a sectional side view, similar to FIG. 3, of another embodiment of a flame simulating assembly according to the invention.
Figure 9:
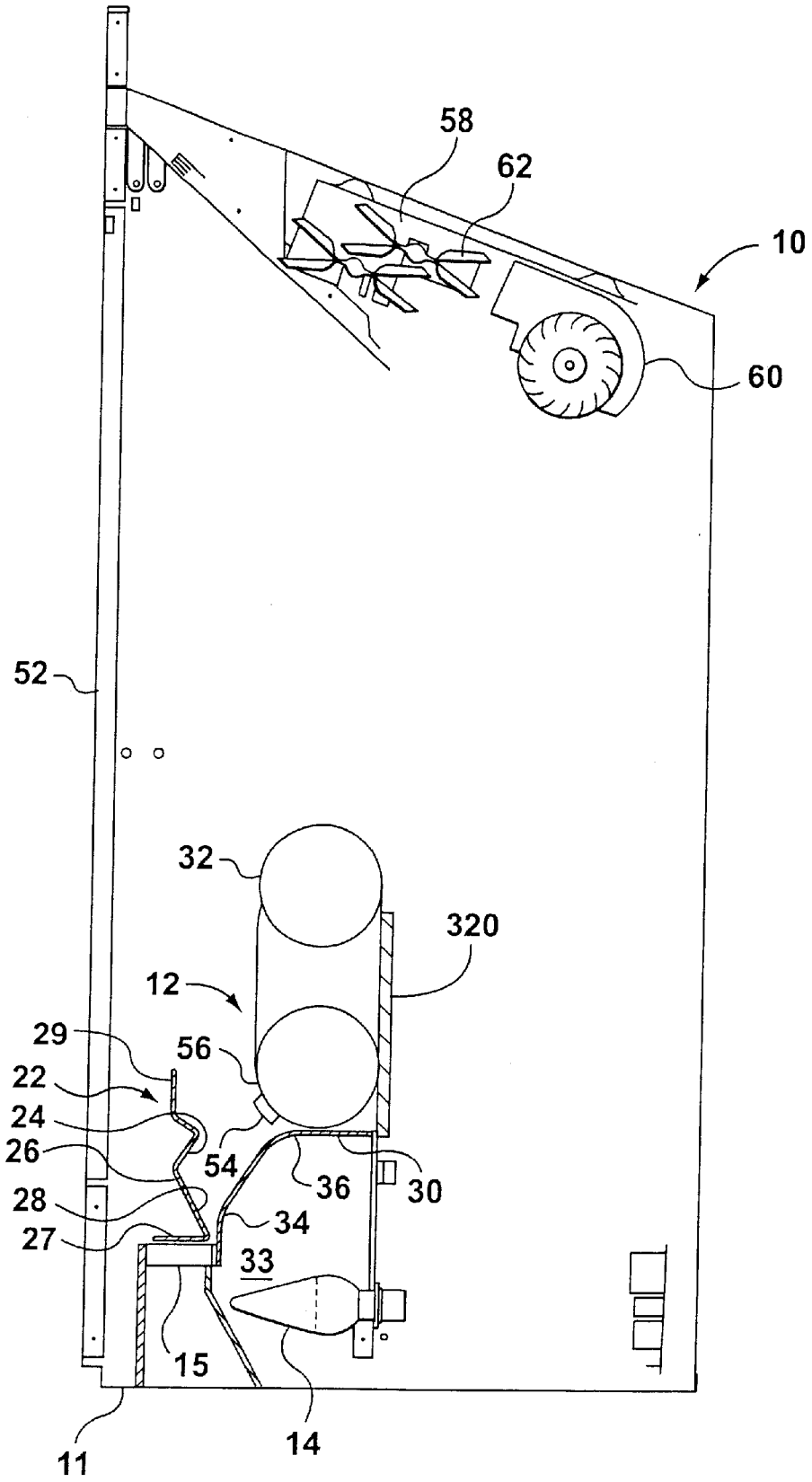
FIG. 9 is a sectional side view, similar to FIG. 3, of another embodiment of a flame simulating assembly according to the invention.

Additional embodiments of the invention are shown in FIGS. 8, 8A, and 9. In FIGS. 8, 8A, and 9, elements are numbered so as to correspond to like elements shown in FIGS. 1 through 7.

In another embodiment, shown in FIG. 8, the simulated ember bed 130 includes a plurality of apertures 164, only one of which is shown in FIG. 8, the apertures 164 being positioned in a path of light from the light source 14 to the static reflective surface 28. The static reflective surface 28 is positioned for reflecting light from the light source 14 onto the simulated fuel bed 12. In use, light from the light source 14 is reflected onto a plurality of ember decals 54 from a static reflective surface 28. The ember decals 54 are reddish in color, so that they simulate burning embers when light from the light source 14 is reflected onto the ember decals 54 from the static reflective surface 28.

In FIG. 8A, another embodiment is shown in which screen 216 has a front surface 218 for transmitting light from the light source 14 so that an image of flames appears through the screen 216. Unlike the partially reflective screen 18 included in the preferred embodiment, the front surface 218 is non-reflective. The screen 216 also includes a back member 238, disposed behind the front surface 218. The back member 238 is for diffusing and transmitting light from the light source 14 through the front surface 218. In use, light from the light source 14 is transmitted through the translucent portion 34 to the static reflective surface 28, and reflected onto the simulated fuel bed 12 by the static reflective surface 28.

The additional embodiment shown in FIG. 9 includes a support member 320 for supporting the simulated logs 32. This embodiment does not include elements corresponding to a screen 16, a flame effect element 48, or a flicker element 40. In use, light from the light source 14 is transmitted through the translucent portion 34 to the static reflective surface 28, and reflected onto the simulated fuel bed 12 by the static reflective surface 28.

It will be evident to those skilled in the art that the invention can take many forms and that such forms are within the scope of the invention as claimed.

I claim:

1. A flame simulating assembly having:

a simulated fuel bed including a simulated ember bed and at least one simulated fuel element positioned over the simulated ember bed;

a bottom wall element, the simulated ember bed being positioned at least partially above the bottom wall element and directly attached to the bottom wall element;

the simulated ember bed and the bottom wall element at least partially defining a compartment;

a light source;

the simulated ember bed including a front portion positioned in a path of light from the light source and adapted to permit light to be transmitted therethrough;

a front wall positioned in front of the simulated fuel bed, the front wall including an at least partially light-transmitting panel; and a static reflector attached to the bottom wall element and positioned outside the compartment and between the simulated ember bed and the front wall, the static reflector being positioned above the bottom wall element and in the path of light from the light source for reflecting light from the light source onto said at least one simulated fuel element.

2. A flame simulating assembly as defined in claim 1 wherein said at least one simulated fuel element has at least one downwardly directed portion, the static reflector being positioned relative to said at least one downwardly directed portion for reflecting light from the light source onto said at least one downwardly directed portion.

3. A flame simulating assembly as defined in claim 2 wherein said at least one simulated fuel element additionally includes at least one partially reflective part positioned on said at least one downwardly directed portion of said at least one simulated fuel element in a path of light from the light source reflected from the static reflector, for reflecting light to simulate burning embers.

4. A flame simulating assembly as defined in claim 3 wherein said at least one partially reflective part includes at least one ember decal, said at least one ember decal being positioned on said at least one downwardly directed portion in a path of light from the light source reflected from the static reflector, for reflecting light to simulate burning embers.

5. A flame simulation assembly as defined in claim 4 wherein at least one ember decal is reddish in color, such that at least one ember decal simulates burning embers disposed on said at least one downwardly directed portion of said at least one simulated fuel element.

6. A flame simulating assembly as defined in claim 3 wherein said at least one partially reflective part is reddish in color, such that said at least one partially reflective part simulates burning embers disposed on said at least one downwardly direction portion of said at least one simulated fuel elememt.

7. A flame simulating assembly as defined in claim 2 wherein said at least one simulated fuel element resembles at least one log of wood.

8. A flame simulating assembly as defined in claim 2 wherein said at least one simulated fuel element resembles at least one piece of coal.

9. A flame simulating assembly as defined in claim 1 wherein the simulated ember bed is at least partially translucent.

10. A flame simulating assembly as defined in claim 1 wherein the static reflector has an inner side disposed opposite an outer side thereof, the static reflector being positioned such that the inner side is proximal to the simulated ember bed, the inner side having a static reflective surface thereon, and the outer side having non-reflective finish, whereby the static reflector resembles a fireplace grate.

11. A flame simulating assembly as defined in claim 1 wherein the static reflector includes a plurality of prongs disposed substantially parallel to each other and extending upwardly and disposed substantially along the static reflector, whereby the static reflector resembles a fireplace grate.

12. A flame simulating assembly as defined in claim 1 in which the front portion of the simulated ember bed comprises an at least partially light-transmitting panel.

13. A flame simulating assembly as defined in claim 12 in which the front portion of the simulated ember bed comprises an at least partially translucent panel.

14. A flame simulating assembly as defined in claim 1 in which the front portion of the simulated ember bed includes at least one aperture positioned in the path of tight from the light source between the light source and the static reflector.

15. A flame simulating assembly having:

a simulated fuel bed including a simulated ember bed and at least one simulated fuel element positioned on and above the simulated ember bed;

a light source;

a front reflector positioned in front of the simulated fuel bed and including a static reflective surface;

the static reflective surface being position below said at least one simulated fuel element and in a path of light from the light source to said at least one simulated fuel element;

at least one front light-transmitting portion included in the simulated ember bed and disposed in the path of light between the light source and the static reflective surface, to permit light to be transmitted from the light source to the static reflective surface;

said at least one simulated fuel element having at least one downwardly directed portion; and the static reflective surface being positioned relative to said at least one downwardly directed portion for reflecting light from the light source onto said at least one downwardly directed portion.

16. A flame simulating assembly as defined in claim 15 wherein said at least one simulated fuel element additionally includes at least one partially reflective part positioned on said at least one downwardly directed portion in a path of light from the light source reflected from the front reflector, for reflecting light to simulate burning embers.

17. A flame simulating assembly as defined in claim 16 wherein said at least one partially reflective part includes at least one ember decal, said at least one ember decal being positioned on said at least one downwardly directed portion in a path of light from the light source reflected from the front reflector, for reflecting light to simulate burning embers.

18. A flame simulating assembly as defined in claim 17 wherein said at least one ember decal is reddish in color, such that said at least one ember decal simulates burning embers disposed on said at least one downwardly directed portion of said at least one simulated fuel element.

19. A flame simulating assembly as defined in claim 16 wherein said at least one partially reflective part is reddish in color, such that said at least one partially reflective part simulates burning embers disposed on said at least one downwardly directed portion of said at least one simulated fuel element.

20. A flame simulating assembly as defined in claim 15 wherein the front reflector has an inner side disposed opposite an outer side thereof, the front reflector being positioned such that the inner side is proximal to the simulated ember bed, the inner side having the static reflective surface positioned thereon, and the outer side having a non-reflective finish, whereby the front reflector resembles a fireplace grate.

21. A flame simulating assembly as defined in claim 15 wherein the front reflector includes a plurality of prongs disposed substantially parallel to each other, extending upwardly, and disposed substantially along the front reflector, whereby the front reflector resembles a fireplace grate.

22. A flame simulating assembly having:

a simulated fuel bed including a simulated ember bed and at least one simulated log portion positioned on and above the simulated ember bed;

a light source;

a screen having a partially reflective front surface disposed behind the simulated fuel bed for reflecting an image of the simulated fuel bed and for transmitting light from the light source, the screen having a diffusing back member disposed behind the partially reflective front surface for diffusing and transmitting light from the light source through the partially reflective front surface;

a flicker element positioned in a path of light from the light source to the diffusing back member, the creating a fluctuating light;

a flame effect element positioned in a path of the fluctuating light to configure the fluctuating light, such that an image of flames is transmitted through the front surface of the screen;

a front reflector positioned in front of the simulated fuel bed and including a static reflective surface;

the static reflective surface being positioned below said at least one simulated log portion and in a path of light from the light source to said at least one simulated log portion;

at least one front light-transmitting portion included in the simulated ember bed and disposed in the path of light between the light source and the static reflective surface, to permit light to be transmitted from the light source to the static reflective surface;

said at least one simulated log portion having at least one downwardly directed portion; and the static reflective surface being positioned relative to said at least one downwardly directed portion for reflecting light from the light source onto said at least one downwardly directed portion.

23. A flame simulating assembly as defined in claim 22 wherein said at least one simulated log portion additionally includes at least one partially reflective part positioned on said at least one downwardly directed portion in a path of light from the light source reflected from the front reflector, for reflecting light to simulate burning embers.

24. A flame simulating assembly as defined in claim 23 wherein said at least one partially reflective part includes at least one ember decal, said at least one ember decal being positioned on said at least one downwardly directed portion in a path of light from the light source reflected from the front reflector, to simulate burning embers.

25. A flame simulating assembly as defined in claim 24 wherein said at least one ember decal is reddish in color, such that said at least one ember decal simulates burning embers disposed on the said at least one downwardly directed portion of said at least one simulated fuel element.

26. A flame simulating assembly as defined in claim 23 wherein said at least one partially reflective part is reddish in color, such that said at least one partially reflective part simulates burning embers disposed on said at least one downwardly directed portion of said at least one simulated fuel element.

27. A flame simulating assembly as defined in claim 22 wherein the front reflector has an inner side disposed opposite an outer side thereof, the front reflector being positioned such that the inner side is proximal to the simulated ember bed, the inner side having the static reflective surface positioned thereon, and the outer side having a non-reflective finish, whereby the front reflector resembles a fireplace grate.

28. A flame simulating assembly as defined in claim 22 wherein the front reflector includes a plurality of prongs disposed substantially parallel to each other, extending upwardly, and disposed substantially along the front reflector, whereby the front reflector resembles a fireplace grate.

29. A flame simulating assembly as defined in claim 22 wherein the light source is disposed below the simulated fuel bed, and the flicker element is disposed behind the diffusing back member.

30. A flame simulating assembly as defined in claim 29 wherein the flame effect element is disposed between the flicker element and the diffusing back member.

31. A flame simulating assembly as defined in claim 22 wherein the flame effect element is disposed between the flicker element and the diffusing back member.

32. A flame simulating assembly as defined in claim 22 wherein the light source comprises a plurality of electric light bulbs.

33. A flame simulating assembly having:

a simulated fuel bed including a simulated ember bed and at least one simulated fuel element, said at least one simulated fuel element being positioned over the simulated ember bed, the simulated ember bed including at least one front portion;

a bottom wall element, the simulated ember bed being positioned at least partially above the bottom wall element and directly attached to the bottom wall element;

the simulated ember bed and the bottom wall element at least partially defining a compartment;

a light source;

a front wall positioned in front of the simulated fuel bed, the front wall including an at least partially light-transmitting panel;

a screen having a partially reflective front surface disposed behind the simulated fuel bed for reflecting an image of said simulated fuel bed and fix transmitting light from said light source trough the partially reflective front surface such that an image of flames is transmitted through the partially reflective front surface; and a static reflector attached to the bottom wall element and positioned outside the compartment and between the simulated ember bed and the front wall, said at least one front portion of the simulated ember bed being adapted to permit light to be transmitted therethrough and positioned in a path of light between the light source and the static reflector, the static reflector being positioned for reflecting light from the light source onto the simulated fuel bed.

34. A flame simulating assembly as defined in claim 33 wherein the simulated ember bed includes a plurality of light-transmitting parts, each of the light-transmitting parts in the simulated ember bed being positioned in a path of light from the light source to simulate burning embers.

35. A flame simulating assembly as defined in claim 34 wherein the light-transmitting parts in the simulated ember bed are translucent and reddish in color.

36. A flame simulating assembly as defined in claim 33 wherein said at least one front portion in the simulated ember bed is translucent and reddish in color.

37. A flame simulating assembly as defined in claim 36 wherein the screen additionally includes a back member disposed behind the partially reflective front surface for diffusing and transmitting light from the light source through the partially reflective front surface.

38. A flame simulating assembly as defined in claim 37 additionally including a flicker element positioned behind the diffusing back member and in a path of light from the light source to the diffusing back member, for causing the light to be a flickering light, whereby an image of flickering flames is transmitted through the partially reflective front surface.

39. A flame simulating assembly as defined in claim 38 additionally including a flame effect element positioned between the flicker element and the diffusing back member and in a path of flickering light, to configure the flickering light, whereby an image of flickering flames is transmitted through the partially reflective front surface.

40. A flame simulating assembly as defined in claim 39 wherein the light source comprises a plurality of electric light bulbs.

41. A flame simulating assembly as defined in claim 40 wherein said at least one simulated fuel element includes at least one downwardly directed portion having at least one partially reflective part thereon, the partially reflective part being positioned in a path of light from the light source reflected from the static reflective surface, for reflecting light to simulate burning embers.

42. A flame simulating assembly as defined in claim 41 wherein said at least one partially reflective part includes at least one ember decal, said at least one ember decal being positioned on said at least one downwardly directed portion in a path of light from the light source reflected from the static reflective surface, for reflecting light to simulate burning embers.

43. A flame simulating assembly as defined in claim 41 wherein said at least one partially reflective part is reddish in color, such that said at least one partially reflective part simulates burning embers disposed on said at least one downwardly directed portion.

44. A flame simulating assembly as defined in claim 42 wherein said at least one ember decal is reddish in color, such that said at least one ember decal simulates burning embers disposed on said at least one downwardly directed portion.

45. A flame simulating assembly as defined in claim 39 wherein the light source comprises at least one natural gas flame.

46. A flame simulating assembly as defined in claim 33 wherein said at least one simulated fuel element resembles at least one log of wood.

47. A flame simulating assembly as defined in claim 33 wherein said at least one simulated fuel element resembles at least one lump of coal.

48. A flame simulating assembly as defined in claim 33 wherein the static reflector has an inner side disposed opposite an outer side thereof, the static reflector being positioned such that the inner side is proximal to the simulated ember bed, the inner side having a static reflective surface thereon, and the outer side having a non-reflective finish whereby the static reflector resembles a fireplace grate.

49. A flame simulating assembly as defined in claim 33 wherein the static reflector includes a plurality of prongs disposed substantially parallel to each other and extending upwardly and disposed substantially along the static reflector, whereby the static reflector resembles a fireplace grate.

50. A flame simulating assembly as defined in claim 33 in which said at least one front portion of the simulated ember bed includes at least one aperture positioned in the path of light from the light source between the light source and the static reflector.

* * * * *

UNITED STATES PATENT AND TRADEMARK OFFICE

CERTIFICATE OF CORRECTION

PATENT NO. : 6,615,519 B2
DATED : September 9, 2003
INVENTOR(S) : Kristoffer Hess It is certified that error appears in the above-identified patent and that said Letters Patent is hereby corrected as shown below:

Column 7,
Line 59, should read -- and the outer side having a non-reflective finish,... --.

Column 8,
Line 9, replace the word “tight” with the word -- light --.
Line 18, replace the word “position” with the word -- positioned --.

Column 9,
Line 19, delete should read -- for creating a fluctuating light; --

Column 10,
Line 43, replace the word “fix” with the word -- for --.
Line 44, replace the word “trough” with the word -- through --.

Signed and Sealed this

Fifth Day of April, 2005

JON W. DUDAS
*Director of the United States Patent and Trademark Office*